US005425822A

United States Patent [19]

Hidaka et al.

[11] Patent Number: 5,425,822

[45] Date of Patent: * Jun. 20, 1995

[54] HARD FACING CHROMIUM-BASE ALLOYS

[75] Inventors: Kensuke Hidaka, Sakyo; Kanichi Tanaka, Yawata; Yoshio Kohira, Uji; Hideshi Yamaguchi, Ichinomiya; Yoshinao Suzuki, Toyota; Masahiro Nakagawa, Toyota; Yoshio Fuwa, Toyota; Kazuhiko Mori, Toyota; Yoshihiko Ito, Toyota; Atsushi Taguchi, Oobu, all of Japan

[73] Assignee: Fukuda Metal Foil & Powder Co., Ltd., Kyoto, Japan

[ * ] Notice: The portion of the term of this patent subsequent to May 24, 2011 has been disclaimed.

[21] Appl. No.: 158,982

[22] Filed: Nov. 30, 1993

Related U.S. Application Data

[63] Continuation of Ser. No. 883,960, May 15, 1992, Pat. No. 5,314,659.

[30] Foreign Application Priority Data

| | | | |
|---|---|---|---|
| Aug. 27, 1991 | [JP] | Japan | 3-214026 |
| Dec. 13, 1991 | [JP] | Japan | 3-329196 |
| Dec. 13, 1991 | [JP] | Japan | 3-329197 |
| Dec. 13, 1991 | [JP] | Japan | 3-329198 |
| Dec. 13, 1991 | [JP] | Japan | 3-329199 |
| Dec. 13, 1991 | [JP] | Japan | 3-329200 |
| Jan. 31, 1992 | [JP] | Japan | 4-15995 |
| Mar. 31, 1992 | [JP] | Japan | 4-76631 |

[51] Int. Cl.[6] ..... C22C 27/06

[52] U.S. Cl. ..... 148/407; 148/419; 148/423; 420/428; 420/584.1; 420/585; 420/588

[58] Field of Search ..... 420/428, 584, 585, 586, 420/586.1, 588; 148/407, 419, 423

[56] References Cited

U.S. PATENT DOCUMENTS

| | | | |
|---|---|---|---|
| 3,759,704 | 9/1973 | Culling | 420/582 |
| 4,181,523 | 1/1980 | Bhansali | 420/428 |
| 4,325,994 | 4/1982 | Kitashima et al. | 428/667 |
| 4,728,493 | 1/1988 | Vreeland | 420/428 |
| 5,314,659 | 5/1994 | Hidaka et al. | 420/428 |

FOREIGN PATENT DOCUMENTS

| | | |
|---|---|---|
| 68284 | 1/1983 | European Pat. Off. . |
| 357216 | 3/1990 | European Pat. Off. . |
| 2168402 | 8/1973 | France . |
| 2371515 | 6/1978 | France . |
| 1608116 | 12/1970 | Germany . |
| 62-256941 | 11/1987 | Japan . |
| 63-11644 | 1/1988 | Japan . |

*Primary Examiner*—George Wyszomierski
*Attorney, Agent, or Firm*—Banner, Birch, McKie & Beckett

[57] ABSTRACT

A hard facing chromium-base alloy consisting essentially of 30.0 to 48.0% by weight of nickel. 1.5 to 15.0% by weight of tungsten and/or 1.0 to 6.5% by weight of molybdenum, the balance being more than 40.0% by weight of chromium, and the maximum sum of tungsten and molybdenum being 15.0% by weight. The alloy may also contain one or more of iron, cobalt, carbon, boron, aluminum, silicon, niobium and titanium. When the alloy is used in powder form as a material for hard facing by welding, the alloy may further contain 0.01 to 0.12% by weight of aluminum, yttrium, misch metal, titanium, zirconium and hafnium. 0.01 to 0.1% by weight of oxygen may also be added to the alloy. The alloy has a high degree of toughness wear resistance and corrosion resistance. The alloy can be used as a hard facing material to be applied to various objects, such as automobile engine valves.

6 Claims, 1 Drawing Sheet

HARD FACING CHROMIUM-BASE ALLOYS

This application is a continuation of Ser. No. 07/883,960 filed May 15, 1992, now U.S. Pat. No. 5,314,659.

BACKGROUND OF THE INVENTION

This invention relates to hard facing chromium-base alloys which have a high degree of toughness, wear resistance and corrosion resistance, and pow3ders of the chromium-base alloys which have good weldability for hard facing. This invention also relates to automobile engine valves provided with a hard facing layer of the alloys of the invention, which have a high degree of wear resistance and corrosion resistance.

There are known various wear- and corrosion-resistant hard facing materials such as stellite and other cobalt-chromium-tungsten alloys (to be referred to as Co-Cr alloys), and colmonoy and other nickel-chromium-boron-silicon alloys (to be referred to as Ni-Cr alloys). These alloys are used for hard facing various kinds of structures or machine parts which are subjected to different conditions of use. In recent years the environment in which they are used has become so severe that the wear resistance and corrosion resistance of the known alloys have become insufficient in many applications, and there has been an increasing demand for hard facing materials which have toughness, wear resistance, corrosion resistance and other properties higher than those of Co-Cr or Ni-Cr alloys.

With recent increasing use of high-energy sources such as laser or plasma for hard facing, there has also been a demand for hard facing materials having a high degree of toughness, that is, less susceptible to cracks or fissures which would occur in the hard facing layer in rapid heating and cooling in the hard facing process. With respect to toughness, Co-Cr alloys may be satisfactory with an impact value of 1.0 kgf-m/cm$^2$. Ni-Cr alloys, however, are poor in toughness with an impact value of 0.15 to 0.2 kgf-m/cm$^2$, so that cracks may occur in the hard facing layer of the alloys in objects of large sizes or particular shapes.

Japanese unexamined patent application No. 56-9348 discloses a malleable, highly heat-resistant alloy consisting of 10 to 25% by weight of chromium and 10 to 25% by weight of tungsten, the balance being nickel. The alloy has a disadvantage that it is low in hardness and wear resistance.

In an effort to solve the above problems of Co-Cr and Ni-Cr alloys and satisfy the demand for better hard facing materials, the present inventors have conducted various studies and experiments for producing alloys having a high degree of toughness, wear resistance and corrosion resistance, and found that by increasing the amount of chromium in Cr-Ni-W alloy it is possible to increase the hardness of the alloy, and that if molybdenum is added to or substituted for tungsten, the resulting alloy has similar characteristics, and invented hard facing chromium-base alloys which are superior in toughness, wear resistance and corrosion resistance.

Studies and experiments have also been conducted for Cr-Ni-W alloys which can be used in the form of powder for hard facing by plasma or laser welding without deterioration of the shape of the bead formed on the hard facing layer or formation of blowholes in the layer. It has been found out that by adding, if necessary, to the alloy powder one or more of aluminum, yttrium, misch metal, titanium, zirconium and hafnium, and/or by limiting, if necessary, the amount of oxygen contained in the alloy powder, it is possible to certainly prevent formation of blowholes and suppress sputtering which would otherwise be caused under certain conditions of hard facing thereby to improve the shape of the bead formed on the hard facing layer.

SUMMARY OF THE INVENTION

Accordingly, one object of the invention is to provide a hard facing chromium-base alloy which comprises 30.0 to 48.0% by weight of nickel, 1.5 to 15.0% by weight of tungsten and/or 1.0 to 6.5% by weight of molybdenum, the balance being more than 40% by weight of chromium and the maximum sum of tungsten and molybdenum being 15.0% by weight.

Another object of the invention is to provide a hard facing chromium-base alloy of the above-mentioned composition in the form of powder.

If necessary, less than 15.0% by weight of iron and/or less than 10.0% by weight of cobalt may be added to the above composition. In this case the maximum sum of iron and cobalt to be added is 20% by weight. Furthermore, if necessary, one or more of 0.3 to 2.0% by weight of carbon, 0.1 to 1.5% by weight of boron, 0.1 to 3.0% by weight of silicon, 0.5 to 2.5% by weight of aluminum and 0.5 to 2.5% by weight of titanium may also be added to the above composition. Furthermore, if necessary, either one or both of 1.0 to 4.0% by weight of niobium and 0.5 to 2.5% by weight of titanium may be added to the above compositions, the maximum sum of the two elements being 5.0% by weight.

If the alloys of the invention are used in the form of powder for hard facing by welding, one or more of aluminum, yttrium, misch metal, titanium, zirconium and hafnium may also be added to the above-mentioned compositions in an amount of 0.01 to 0.12% by weight, and the amount of oxygen is restricted to 0.01 to 0.1% by weight.

DETAILED DESCRIPTION OF THE INVENTION

Figure 1A:
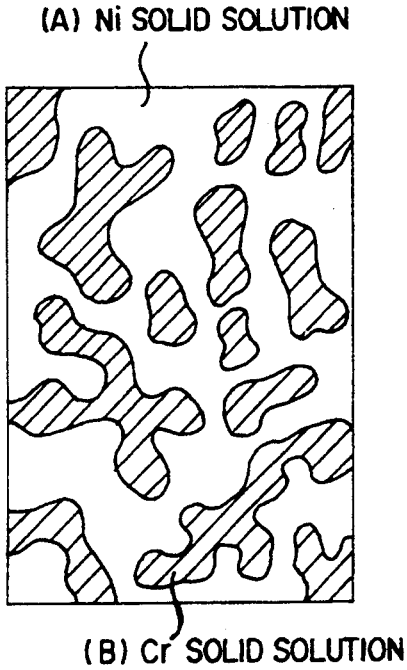
FIGS. 1*a* and 1*b* schematically show the metallographic views of the alloys of specimens No. 1 and No. 4 of the invention as shown in table 1.
Figure 1B:
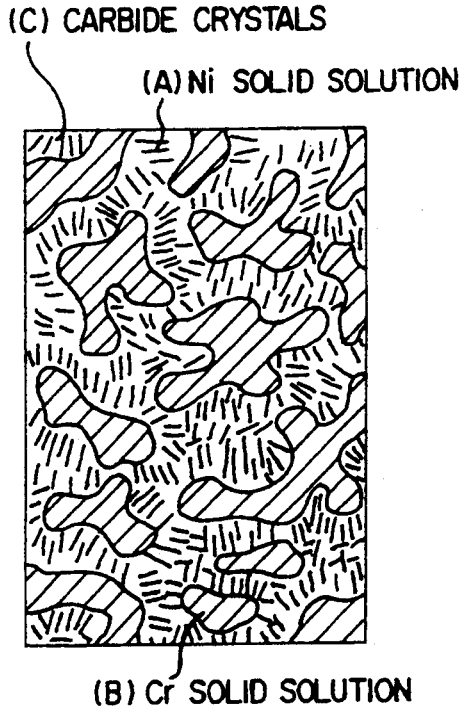

The invention will be described below in detail. As schematically shown in FIG. 1, the hard facing chromium-base alloy of the invention consists essentially of a nickel solid solution which is highly tough and a chromium solid solution which has high wear resistance. The components of the alloy are in melted condition above about 1400° C. As the temperature of the alloy decreases, at about 1300° C. chromium solid solution begins to be crystallized as primary crystal, and as the temperature of the chromium solid solution further decreases (cools down) to about 980° C., a chromium-rich phase and a nickel-rich phase are separately precipitated. It is not clear whether the separate precipitation is caused by reduction of the solid solubility of nickel in chromium or by eutectoid transformation. Therefore, the mixture of the nickel-rich and chromium-rich phases separately precipitated from the chromium solid solution is referred to as the chromium solid solution in the present specification and claims.

In accordance with the invention, the wear resistance of the alloys can be improved by adding one or more of iron, cobalt, carbon, boron, silicon, niobium and titanium to the basic composition of the alloys. Chromium contained in an amount between 67.5 and 40.0% by weight helps improve the corrosion resistance of the alloys. These properties combined make the alloys of the invention superior in not only toughness but also corrosion and wear resistance. Silicon improves the meltability of the alloys and aluminum, the resistance thereof to oxidation.

The reasons why blowholes are scarcely formed in the hard facing layer of the alloys of the invention are as follows: The causes for blowholes formed in the hard facing layer of a known alloy are not known but believed to be as follows: In the process of hard facing by welding, a pool of molten alloy is formed, in which carbon and/or a minute amount of hydrogen are dissolved. As oxygen enters the pool, it reacts with the dissolved carbon and/or hydrogen to produce CO and/or $H_2O$. The CO and/or $H_2O$ are vaporized to blow off through the hard facing layer so that blowholes are formed in the layer. Therefore, to prevent formation of blowholes it is necessary to prevent gases, particularly, oxygen from entering into the hard facing layer from outside when the layer is formed.

In accordance with the invention, when a hard facing layer is formed, aluminum, yttrium, misch metal, titanium, zirconium, or hafnium added to the alloy reacts with oxygen to produce a stable oxide, which covers the pool of molten alloy formed in the layer thereby to serve as a protective film to prevent invasion of gases, particularly oxygen into the pool and, consequently, formation of blowholes in the layer. A suitable amount of oxygen added to the alloy powder beforehand is more effective in forming such a protective film on the hard facing layer.

The reasons why the hard facing chromium-base alloy powders of the invention are effective in preventing sputtering and improving the shape of the bead formed on the hard facing layer are as follows: The mechanism from melting of an alloy powder to solidification thereof in forming a hard facing layer of the alloy powder by laser welding is believed to be as follows: When a laser beam is applied to a layer of an alloy powder deposited on a base metal, the energy of the beam is absorbed in the powder and simultaneously gives heat to the base metal thereby to form a pool of the molten alloy. As the base metal is moved relatively to the laser beam, the pool thereon is moved out of the laser beam so as to be cooled down and solidified, and alloy powder is continuously supplied so that a continuous hard facing layer is formed on the base metal. The characteristic of the method which uses a laser beam as a heat source is that the light of the laser beam is converted into heat, which heats and melts the alloy. In this respect, the efficiency of absorption of a laser beam by alloy powder or a pool of molten alloy powder is very important.

In accordance with the invention, the added one or more of aluminum, yttrium, misch metal, titanium, zirconium and hafnium react with oxygen to form an oxide film on the surface of the alloy powder or the pool of molten alloy powder. The oxide film is thermally stable and efficiently absorbs the energy of the laser beam, so that a stable, efficient supply of heat energy to the alloy powder or the pool of molten alloy powder is ensured thereby to form a proper pool of molten alloy powder. The oxide film also helps increase the apparent viscosity of the molten alloy of the pool and prevent not only any turbulence which would otherwise be caused by a high energy laser beam to occur in the pool of the molten alloy, with resulting entanglement of gas and formation of blowholes therein, but also formation of an irregular-shaped bead with the molten alloy solidified with its disturbed surface as it is, and sputtering caused by the gas which is entangled in the hard facing layer and blows off part of the molten alloy of the pool as the entangled gas leaves the pool.

The reasons why the compositions of the hard facing chromium-base alloys of the invention and the amounts of the components thereof have been determined as given herein are as follows:

(a) Chromium (Cr).

Chromium constitutes the balance in the composition of the alloy of the invention and forms a hard chromium solid solution containing nickel, tungsten and/or molybdenum. The chromium solid solution functions to increase both the wear resistance and corrosion resistance of the alloy. With less than 40.0% by weight of chromium, the wear resistance is inferior and the corrosion resistance is not improved. Therefore, the amount of chromium to be contained should be more than 40.0% by weight.

(b) Nickel (Ni).

Nickel forms a tough nickel solid solution containing chromium and tungsten and/or molybdenum. With less than 30.0% by weight of nickel, the amount of chromium solid solution increases, so that the resulting alloy becomes less tough. With more than 48.0% by weight of nickel, the hardness of the resulting alloy is insufficient and the wear resistance is reduced although the toughness increases. Therefore, the nickel content should be 30.0 to 48.0% by weight in this invention.

(c) Tungsten (W) and molybdenum (Mo).

Tungsten and/or molybdenum are dissolved in chromium and nickel in the solid state so as to increase the strength of the resulting alloy. With less than 1.5% by weight of tungsten or less than 1.0% by weight of molybdenum, no appreciable effect is observed. With more than 15.0% by weight of tungsten or more than 6.5% by weight of molybdenum, a $\sigma$ phase which is inferior in toughness is precipitated, with resulting reduction of the toughness of the alloy. Therefore, the amount of tungsten should be 1.5 to 15.0% by weight and the amount of molybdenum should be 1.0 to 6.5% by weight. If the total amount of tungsten and molybdenum exceeds 15.0% by weight, the toughness decreases. Therefore, the total amount should be below 15.0% by weight.

(d) Iron (Fe) and cobalt (Co).

Iron and/or cobalt added, if necessary, are dissolved chiefly in nickel in the solid state to increase the hardness of the nickel solid solution and consequently improve the wear resistance of the alloy. More than 15.0% by weight of iron reduces not only the toughness of the alloy but also the corrosion resistance thereof. More than 10.0% by weight of cobalt has little effect and lowers the toughness of the alloy. If the total amount of iron and cobalt exceeds 20% by weight, the toughness of the alloy is reduced. Therefore, the amounts of iron and cobalt should be below 15.0 and 10.0% by weight, respectively, and the maximum total amount of the two elements should be 20% by weight.

(e) Carbon (C).

Carbon added, if necessary, is combined with chromium to form chromium carbide, which helps increase the wear resistance of the alloy. Chromium carbide with a low carbon content forms a eutectic with the nickel solid solution. Chromium carbide with a high carbon content crystallizes as proeutectic carbide. Less than 0.3% by weight of carbon has little effect on improvement of the wear resistance of the alloy while more than 2.0% by weight of carbon reduces the toughness of the alloy. Therefore, the amount of carbon should be 0.3 to 2.0% by weight.

(f) Boron (B).

Boron added, if necessary, is combined with chromium to form chromium boride, which helps increase the wear resistance of the alloy. The chromium boride forms a eutectic with the nickel solid solution. Less than 0.1% by weight of boron has little effect on improvement of the wear resistance of the alloy while more than 1.5% by weight of boron reduces the toughness of the alloy. Therefore, the amount of boron to be added should be 0.1 to 1.5% by weight.

(g) Silicon (S).

Silicon added, if necessary, is dissolved chiefly in nickel in the solid state and enters into the nickel solid solution to increase its hardness thereby to help improve the wear resistance of the alloy. Silicon functions as a deoxidizer in the process of hard facing and improves the meltability of the alloy. If the amount of silicon is less than 0.1% by weight, the above effect is not attained. If the amount is more than 3.0% by weight, the toughness of the alloy is reduced. Therefore, the amount of silicon should be 0.1 to 3.0% by weight.

(h) Aluminum (Al).

Aluminum added, if necessary, helps improve the resistance of the alloy of oxidation and forms an intermetallic compound with nickel so as to improve the strength or toughness of the alloy. With less than 0.5% by weight of aluminum, no such improvement is attained. With more than 2.5% by weight of aluminum, the toughness of the alloy is reduced and the weldability thereof in hard facing is deteriorated. Therefore, the amount of aluminum should be 0.5 to 2.5% by weight.

(i) Niobium (Nb) and titanium (Ti).

Niobium and/or titanium added, if necessary, form an intermetallic compound with nickel and further improve the strength or toughness of the alloy. Niobium or titanium is combined with carbon, if added, to form niobium carbide or titanium carbide, or with boron, if added, to form niobium boride or titanium boride thereby to help improve the wear resistance of the alloy. With less than 1.0% by weight of niobium or less than 0.5% by weight of titanium, no improvement in the wear resistance is attained. With more than 4.0% by weight of niobium, the toughness of the alloy is deteriorated. With more than 2.5% by weight of titanium, not only the toughness but also the weldability in the operation of hard facing are deteriorated. Therefore, the amount of niobium should be 1.0 to 4.0% by weight and that of titanium, 0.5 to 2.5% by weight.

In case both niobium and titanium are added at the same time, if the total amount of the two elements exceeds 5.0% by weight, the toughness of the alloy is reduced. Therefore, the total amount of the two elements should not exceed 5.0% by weight.

(j) Aluminum (Al), yttrium (Y), misch metal, titanium (Ti), zirconium (Zr) and hafnium (Hf).

When the alloys of the invention are to be used in powder form for hard facing by welding, if necessary, one or more of Al, Y, misch metal, Ti, Zr and Hf may be added to the compositions of the alloys in an amount of 0.01 to 0.12% by weight. Al, Y and misch metal containing La and Ce which belong to the third group of the periodic table of elements, and Ti, Zr and Hf which belong to the fourth group of the periodic table have a larger amount of free energy for formation of oxides than the other component elements of the alloys, so that if added in a small amount, they react with oxygen to form a stable oxide.

When the alloy of the invention containing a small amount of one or more than two of the above elements is applied in powder form to an article to form a hard facing layer thereon by welding, a stable oxide film is formed in the welding process to cover the surface of the alloy powder or a pool of the molten alloy powder thereby to prevent oxygen from entering into the alloy layer. If a laser beam is used as an energy source for welding, the alloy layer effectively absorbs the laser energy thereby to form a proper pool of the molten alloy and calm down the turbulence in the surface of the pool. A single one of the above elements or more than two of them can be added with the same effect.

With less than 0.01% by weight of one or more than two of the above elements, the oxide film formed is not sufficient to prevent intrusion of oxygen into the alloy layer but has a high reflection rate to a laser beam, so that a poor pool of the molten alloy is formed, with resulting formation of blowholes in the bead formed and deterioration of the shape thereof.

If the amount exceed 0.12% by weight, more oxide film than is necessary is formed uselessly. Therefore, the amount of one or more of Al, Y, misch metal, Ti, Zr and Hf to be added to the composition of the alloys of the invention should be 0.01 to 0.12% by weight.

(k) Oxygen ([O]).

When the alloys of the invention are used in powder form for forming a hard facing layer by welding, the oxygen contained in the alloys and expressed as [O] is limited to 0.01 to 0.1% by weight. With less than 0.01% by weight of oxygen, the amount of oxide film formed by reaction of oxygen with aluminum or other elements to cover the deposited alloy powder or the pool of molten alloy is insufficient, so that more oxygen enters the pool of molten alloy to cause blowholes to be formed therein or an insufficient amount of laser beam is absorbed, with resulting deterioration of the hard facing layer formed.

If the amount of oxygen contained in the alloys exceeds 0.1% by weight, blowholes are likely to be formed in the hard facing layer. Therefore, the amount of oxygen to be contained in the alloys should be 0.01 to 0.1% by weight.

DESCRIPTION OF PREFERRED EMBODIMENTS

Preferred embodiments of the invention will be described below.

(Embodiment 1)

Table I shows the composition, hardness and impact value of the alloys of the invention whose basic components are chromium, nickel and tungsten, as compared with those of the alloys prepared for purposes of comparison (to be referred to as the control alloys), that is, the alloys whose compositions are outside the scope of the invention, Co-Cr alloy and Ni-Cr alloy.

For preparation of the specimens, 100 g of the alloy of each of the different compositions as shown in the table is melted in an atmosphere of argon in a conventional electric furnace, and the melt is cast into a shell mould to produce a cast body, which is machined to form a JIS Z 2201 No. 3 specimen without a notch. The specimens of the different compositions are then subjected to impact tests in accordance with the JIS Z 2242 procedure by using a Charpy impact testing machine having a capacity of 15.0 kgf-m. After the impact tests and end surfaces of the specimens are tested for hardness. After the hardness test the tested end surfaces of specimen Nos. 1 and 4 are ground and etched for metallographic observation by a microscope.

TABLE 1

| Specimen No. | Composition (% by weight) Cr | Ni | W | C | B | Al | Nb | Ti | Hardness HRC | Impact Value (kgf-m/cm$^2$) |
|---|---|---|---|---|---|---|---|---|---|---|
| Alloys of Invention | | | | | | | | | | |
| 1 | Bal. | 30.0 | 15.0 | — | — | — | — | — | 48.1 | 0.90 |
| 2 | Bal. | 40.0 | 8.0 | — | — | — | — | — | 40.2 | 2.10 |
| 3 | Bal. | 45.0 | 2.0 | — | — | — | — | — | 37.5 | 3.40 |
| 4 | Bal. | 45.0 | 2.5 | 0.5 | — | — | — | — | 40.3 | 1.20 |
| 5 | Bal. | 42.5 | 5.0 | 1.8 | — | — | — | — | 43.6 | 0.95 |
| 6 | Bal. | 40.0 | 2.5 | — | 0.5 | — | — | — | 42.5 | 1.40 |
| 7 | Bal. | 40.0 | 5.0 | — | — | 2.0 | — | — | 39.2 | 2.20 |
| 8 | Bal. | 42.5 | 5.0 | — | — | — | 3.8 | — | 38.5 | 1.20 |
| 9 | Bal. | 38.0 | 10.0 | — | — | — | — | 2.0 | 45.0 | 1.00 |
| 10 | Bal. | 42.5 | 2.5 | 0.7 | 1.0 | — | — | — | 41.3 | 1.42 |
| 11 | Bal. | 45.0 | 5.0 | 0.5 | 0.2 | 1.0 | 1.5 | 1.0 | 43.5 | 1.15 |
| 12 | Bal. | 38.0 | 7.0 | — | — | 1.0 | 2.0 | 1.0 | 44.3 | 1.15 |
| Control Alloys | | | | | | | | | | |
| 1 | Bal. | 50.0 | 3.0 | — | — | — | — | — | 16.5 | 10.7 |
| 2 | Bal. | 30.0 | 20.0 | — | — | — | — | — | 59.6 | 0.15 |
| 3 | 20.0 | Bal. | 20.0 | — | — | — | — | — | 8.0 | 14.3 |
| 4 | Co—Cr Alloy:Bal.Co—28Cr—4W—1C—3Fe | | | | | | | | 43.0 | 1.00 |
| 5 | Ni—Cr Alloy:Bal.Ni—12Cr—2.5B—3.75Si—0.5C—4.5Fe | | | | | | | | 47.0 | 0.15 |

As is apparent from Table 1, the impact values of the alloys of the invention are considerably higher than that of the control alloy of specimen No. 5 (Ni-Cr alloy), and nearly equal to or higher than that of the control alloy of specimen No. 4 (Co-Cr alloy). As shown in FIG. 1, the alloys of the invention have a texture that the nickel solid solution A which is superior in toughness surrounds the chromium solid solution B which is superior in wear and corrosion resistance. In the alloys which contain carbon, minute carbide crystals are formed in the nickel solid solution A.

The control alloys of specimen Nos. 1 and 2 have compositions outside those of the alloys of the invention. The control alloy of specimen No. 1 containing a relatively large amount of nickel has a high impact value of 10.7. However, it has a low hardness of 16.5 in Rockwell C scale and is not satisfactory in respect of wear resistance. The control alloy of specimen No. 2 containing a relatively large amount of tungsten has a low impact value of 0.15, which is the same as that of nickel-chromium alloy due to the $\sigma$ phase inferior in toughness having been precipitated. The control alloy of specimen No. 3, which is disclosed in Japanese unexamined patent publication No. 56-9348, has a fairly low hardness of 8.0 and consequently an unsatisfactorily poor wear resistance, and is not suitable for use as a hard facing material.

Wear and corrosion tests are conducted on the alloys of the invention of specimens Nos. 1, 4, 5, 6, 10 and 11 and the control alloys of specimen Nos. 4 and 5 (Co-Cr alloy and Ni-Cr alloy) shown in Table 1.

Figure 2:
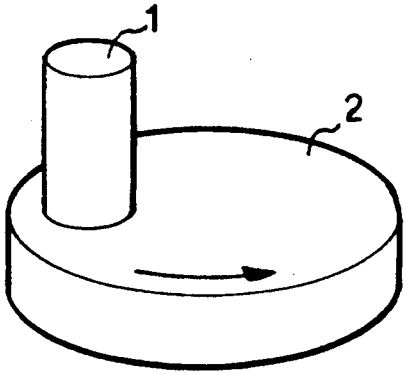
FIG. 2 schematically shows the method of testing the wear resistance of the alloys of the invention and that of control alloys.

The wear tests are conducted in the following manner. 50 g of each of the alloys of the listed compositions is melted in an atmosphere of argon in a conventional electric furnace, and the melt is cast into a shell mould to produce a cast body, which is machined into a pin-like piece having a diameter of 7.98 mm and a length of 20.0 mm. Each of the pins prepared in the above manner is pressed against a rotating disk as shown in FIG. 2, and the lost volume of the material of each of the pins is measured.

The test conditions are as follows:

| | |
|---|---|
| Test temperature | room temperature |
| Load imposed | 10 kgf (surface pressure of 20 kgf/cm$^2$) |
| Friction speed | 0.1 m/sec |
| Friction distance | 1000 m |
| Lubrication | none |
| Material of disk | SACM 645 (nitrided) |

The corrosion tests are conducted in the following manner. 50% of each of the alloys of the listed compositions is melted in an atmosphere of argon in a conventional electric furnace, and the melt is cast into a glass mould having an inner diameter of 6.0 mm to form a cast rod, which is cut into a 10 mm long specimen to be tested. Each of the specimens thus prepared is put in a bath of molten PbO at 900° C. and kept there for 60 minutes, after which the weight loss of the specimen by corrosion is measured.

The results of the wear and corrosion tests are shown in Table 2.

TABLE 2

| Specimen No. | Volume Loss by Wear (mm$^3$) | Weight Loss by Corrosion (mg/cm$^2$/hr) |
|---|---|---|
| Alloys of Invention | | |
| 1 | 0.19 | 16 |
| 4 | 0.15 | 20 |
| 5 | 0.09 | 21 |

TABLE 2-continued

| Specimen No. | Volume Loss by Wear ($mm^3$) | Weight Loss by Corrosion ($mg/cm^2/hr$) |
|---|---|---|
| 6 | 0.15 | 23 |
| 10 | 0.07 | 25 |
| 11 | 0.10 | 19 |
| Control Alloys | | |
| 4 | 0.25 | 71 |
| 5 | 0.31 | 396 |

Control alloy No. 4: Co—Cr Alloy
Control alloy No. 5: Ni—Cr Alloy

As is apparent from Table 2, in the alloys of the invention the volume lost by wear is 0.07 to 0.19 $mm^3$, which indicate an improvement in wear resistance over Ni-Cr and Co-Cr alloys. Among the alloys of the invention, the alloys of specimen Nos. 5, 10 and 11 which contain carbon or both carbon and boron have a higher wear resistance than those which do not contain these elements. The weight lost by corrosion is 16 to 25 $mg/cm^2/hr$, which indicate an improvement in corrosion resistance over Ni-Cr and Co-Cr alloys.

(Embodiment 2)

Table 3 shows the hardness and impact value of the chromium-base alloys of the invention containing silicon. The method of preparing the specimens for the tests and that of testing them are the same as in embodiment 1. The control alloys of specimen Nos. 6, 7 and 8 have a composition outside those of the alloys of the invention.

As is apparent from Table 3, the addition of silicon improves the hardness of the alloys but lowers the impact value thereof. With more than 3.0% by weight of silicon as in the control alloy No. 8, the alloy becomes inferior in toughness, with the impact value being lowered to 0.20.

TABLE 3

| Specimen No. | Composition (% by weight) Cr | Ni | W | Si | C | B | Al | Nb | Ti | Hardness HRC | Impact Value ($kgf\text{-}m/cm^2$) |
|---|---|---|---|---|---|---|---|---|---|---|---|
| Alloys of Invention | | | | | | | | | | | |
| 13 | Bal. | 30.0 | 15.0 | 0.1 | — | — | — | — | — | 48.5 | 0.90 |
| 14 | Bal. | 40.0 | 8.0 | 1.0 | — | — | — | — | — | 42.4 | 1.66 |
| 15 | Bal. | 45.0 | 2.0 | 3.0 | — | — | — | — | — | 46.5 | 1.10 |
| 16 | Bal. | 45.0 | 2.5 | 0.5 | 0.5 | — | — | — | — | 40.8 | 1.15 |
| 17 | Bal. | 42.5 | 5.0 | 0.5 | 1.8 | — | — | — | — | 44.1 | 0.90 |
| 18 | Bal. | 40.0 | 2.5 | 0.5 | — | 0.5 | — | — | — | 42.9 | 1.40 |
| 19 | Bal. | 40.0 | 5.0 | 0.5 | — | — | 2.0 | — | — | 39.8 | 2.10 |
| 20 | Bal. | 42.5 | 5.0 | 0.5 | — | — | — | 3.8 | — | 39.0 | 1.70 |
| 21 | Bal. | 38.0 | 10.0 | 0.5 | — | — | — | — | 2.0 | 45.2 | 0.95 |
| 22 | Bal. | 42.5 | 2.5 | 0.5 | 0.7 | 1.0 | — | — | — | 41.8 | 1.35 |
| 23 | Bal. | 45.0 | 5.0 | 0.5 | 0.5 | 0.2 | 1.0 | 1.5 | 1.0 | 43.8 | 1.15 |
| 24 | Bal. | 38.0 | 7.0 | 0.5 | — | — | 1.0 | 2.0 | 1.0 | 44.8 | 1.00 |
| Control Alloys | | | | | | | | | | | |
| 6 | Bal. | 50.0 | 3.0 | 0.5 | — | — | — | — | — | 16.6 | 11.2 |
| 7 | Bal. | 30.0 | 20.0 | 0.5 | — | — | — | — | — | 60.2 | 0.15 |
| 8 | Bal. | 40.0 | 8.0 | 3.5 | — | — | — | — | — | 51.7 | 0.20 |

Table 4 shows the results of the wear and corrosion tests conducted on the alloys of specimen Nos. 13, 16, 17, 18, 22 and 23.

TABLE 4

| Specimen No. | Volume Loss by Wear ($mm^3$) | Weight Loss by Corrosion ($mg/cm^2/hr$) |
|---|---|---|
| Alloys of Invention | | |
| 13 | 0.18 | 18 |
| 16 | 0.08 | 24 |
| 17 | 0.09 | 20 |
| 18 | 0.11 | 21 |
| 22 | 0.07 | 24 |
| 23 | 0.09 | 19 |

As is apparent from Table 4, in the alloys of the invention which contain silicon the volume lost by wear decreases as compared with the alloys which do not contain silicon. Although the weight lost by corrosion in the alloys of the invention containing silicon slightly increases as compared with those which do not contain silicon, they have a higher corrosion resistance than the control alloys of No. 4 (Co-Cr alloy) and No. 5 (Ni-Cr alloy).

(Embodiment 3)

Table 5 shows the hardness and impact value of the chromium-base alloys of the invention containing iron and/or cobalt. The method of preparing the specimens for the tests and that of testing them are the same as in embodiment 1.

TABLE 5

| Specimen No. | Composition (% by weight) Cr | Ni | W | Fe | Co | C | B | Si | Al | Nb | Ti | Hardness HRC | Impact Value ($kgf\text{-}m/cm^2$) |
|---|---|---|---|---|---|---|---|---|---|---|---|---|---|
| Alloys of Invention | | | | | | | | | | | | | |
| 25 | Bal. | 30.0 | 15.0 | 0.1 | — | — | — | — | — | — | — | 48.1 | 0.90 |
| 26 | Bal. | 40.0 | 8.0 | 5.0 | — | — | — | — | — | — | — | 41.1 | 1.05 |
| 27 | Bal. | 40.0 | 2.0 | 15.0 | — | — | — | — | — | — | — | 46.7 | 0.70 |
| 28 | Bal. | 45.0 | 2.0 | 2.0 | — | — | — | — | — | — | — | 38.1 | 3.20 |
| 29 | Bal. | 30.0 | 15.0 | — | 0.1 | — | — | — | — | — | — | 49.0 | 0.90 |

TABLE 5-continued

| Specimen No. | Composition (% by weight) Cr | Ni | W | Fe | Co | C | B | Si | Al | Nb | Ti | Hardness HRC | Impact Value (kgf-m/cm²) |
|---|---|---|---|---|---|---|---|---|---|---|---|---|---|
| 30 | Bal. | 40.0 | 8.0 | — | 5.0 | — | — | — | — | — | — | 43.9 | 0.90 |
| 31 | Bal. | 45.0 | 2.0 | — | 10.0 | — | — | — | — | — | — | 48.2 | 0.75 |
| 32 | Bal. | 30.0 | 15.0 | 0.1 | 0.1 | — | — | — | — | — | — | 48.7 | 0.90 |
| 33 | Bal. | 40.0 | 8.0 | 5.0 | 5.0 | — | — | — | — | — | — | 46.2 | 0.82 |
| 34 | Bal. | 40.0 | 2.0 | 15.0 | 2.0 | — | — | — | — | — | — | 48.2 | 0.66 |
| 35 | Bal. | 40.0 | 2.0 | 5.0 | 10.0 | — | — | — | — | — | — | 50.2 | 0.70 |
| 36 | Bal. | 45.0 | 2.5 | 2.0 | 2.0 | 0.5 | — | — | — | — | — | 44.4 | 1.00 |
| 37 | Bal. | 42.5 | 5.0 | 2.0 | 2.0 | 1.8 | — | — | — | — | — | 45.6 | 0.75 |
| 38 | Bal. | 40.0 | 2.5 | 2.0 | 2.0 | — | 0.5 | — | — | — | — | 45.0 | 1.10 |
| 39 | Bal. | 40.0 | 2.5 | 2.0 | 2.0 | — | — | 0.5 | — | — | — | 43.1 | 1.40 |
| 40 | Bal. | 40.0 | 5.0 | 2.0 | 2.0 | — | — | — | 2.0 | — | — | 43.0 | 1.45 |
| 41 | Bal. | 42.5 | 5.0 | 2.0 | 2.0 | — | — | 3.0 | 2.0 | — | — | 43.1 | 1.02 |
| 42 | Bal. | 42.5 | 5.0 | 2.0 | 2.0 | — | — | — | — | 3.8 | — | 42.0 | 1.00 |
| 43 | Bal. | 38.0 | 10.0 | 2.0 | 2.0 | — | — | — | — | — | 2.0 | 46.4 | 0.90 |
| 44 | Bal. | 42.5 | 2.5 | 2.0 | 2.0 | 0.7 | 1.0 | — | — | — | — | 44.0 | 1.12 |
| 45 | Bal. | 45.0 | 5.0 | 2.0 | 2.0 | 0.5 | 2.0 | 0.5 | 1.0 | 1.5 | 1.0 | 45.1 | 0.90 |
| 46 | Bal. | 38.0 | 7.0 | 2.0 | 2.0 | — | — | 0.5 | 1.0 | 2.0 | 1.0 | 46.7 | 0.88 |

As is apparent from Table 5, the addition of iron and/or cobalt increases the hardness of the alloys but decreases the impact value thereof. For example, the impact value of the alloy of specimen No. 27 of the invention containing 15.0% by weight of iron is reduced to 0.70 kgf-m/cm², and the impact value of the alloy of specimen No. 31 containing 10.0% by weight of cobalt is reduced to 0.75 kgf-m/cm². The impact value of the alloy of specimen No. 34 containing iron and cobalt in a total amount of 17.0% by weight is reduced to 0.66 kgf-m/cm². Therefore, although the addition of iron and/or cobalt improves the hardness and wear resistance of the alloys, the amount of iron to be added should be less than 15.0% by weight, and that of cobalt should be less than 10.0% by weight. If both iron and cobalt are added, the total amount should be less than 20.0% by weight.

(Embodiment 4)

Table 6 shows the hardness and impact value of the alloys of the invention containing molybdenum. The method of preparing the specimens for the tests and that of testing them are the same as in embodiment 1.

TABLE 6

| Specimen No. | Composition (% by weight) Cr | Ni | Mo | C | B | Si | Al | Nb | Ti | Hardness HRC | Impact Value (kgf-m/cm²) |
|---|---|---|---|---|---|---|---|---|---|---|---|
| Alloys of Invention | | | | | | | | | | | |
| 47 | Bal. | 30.0 | 6.5 | — | — | — | — | — | — | 49.5 | 0.75 |
| 48 | Bal. | 40.0 | 3.0 | — | — | — | — | — | — | 39.8 | 2.15 |
| 49 | Bal. | 45.0 | 1.0 | — | — | — | — | — | — | 37.0 | 3.05 |
| 50 | Bal. | 45.0 | 2.5 | 0.5 | — | — | — | — | — | 42.1 | 1.00 |
| 51 | Bal. | 42.5 | 2.5 | 1.8 | — | — | — | — | — | 44.0 | 0.85 |
| 52 | Bal. | 40.0 | 2.5 | — | 0.5 | — | — | — | — | 43.0 | 1.20 |
| 53 | Bal. | 40.0 | 2.5 | — | — | 3.0 | — | — | — | 42.5 | 0.95 |
| 54 | Bal. | 40.0 | 2.5 | — | — | 0.5 | — | — | — | 39.8 | 1.60 |
| 55 | Bal. | 40.0 | 2.5 | — | — | — | 2.0 | — | — | 39.0 | 2.10 |
| 56 | Bal. | 40.0 | 2.5 | — | — | 0.5 | 2.0 | — | — | 40.1 | 1.95 |
| 57 | Bal. | 42.5 | 2.5 | — | — | — | — | 3.8 | — | 38.0 | 1.25 |
| 58 | Bal. | 38.0 | 5.0 | — | — | — | — | — | 2.0 | 45.0 | 1.00 |
| 59 | Bal. | 42.5 | 1.5 | 0.7 | 1.0 | — | — | — | — | 41.7 | 1.38 |
| 60 | Bal. | 45.0 | 2.5 | 0.5 | 0.2 | 0.5 | 1.0 | 1.5 | 1.0 | 44.0 | 1.11 |
| 62 | Bal. | 38.0 | 3.5 | — | — | 0.5 | 1.0 | 2.0 | 1.0 | 44.3 | 1.05 |

As is apparent from Table 6, the alloys to which molybdenum is added in an amount of about two-fifths (2/5) that of tungsten have much the same hardness and impact values as the alloys to which tungsten is added. The alloys to which one or more of carbon, boron, silicon, etc. are added in addition to molybdenum have much the same values as the alloys given in Table 1 containing those elements in addition to tungsten.

Specimen Nos. 47, 50, 51, 52, 59 and 60 are tested for wear and corrosion resistance in the same manner as in embodiment 1. The results are shown in Table 7.

TABLE 7

| Specinem No. | Volume Loss by Wear (mm³) | Weight Loss by Corrosion (mg/cm²/hr) |
|---|---|---|
| Alloys of Invention | | |
| 47 | 0.17 | 13 |
| 50 | 0.11 | 18 |
| 51 | 0.07 | 18 |
| 52 | 0.10 | 20 |
| 59 | 0.06 | 25 |
| 60 | 0.08 | 18 |

As is apparent from Table 7, in the alloys tested the amounts lost by wear and corrosion are more or less reduced as compared with those of the alloys containing tungsten shown in Table 1 in embodiment 1. Tungsten and molybdenum have substantially the same function in the alloys of the invention.

(Embodiment 5)

Table 8 shows the hardness and impact value of the alloys of the invention containing both tungsten and molybdenum. The method of preparing the specimens for the tests and that of testing them are the same as in embodiment 1. The control alloy of specimen No. 9 contains more than 15.0% by weight tungsten and molybdenum.

As is apparent from Table 8, so long as the total amount of tungsten and molybdenum is less than 15.0% by weight, both the hardness and impact values of the alloys are satisfactory. In the control alloy of specimen No. 9 containing more than 15.0% by weight of tungsten and molybdenum, the hardness increases whereas the impact value is reduced to 0.10 kgf-m/cm$^2$. This is believed to be due to the $\sigma$ phase inferior in toughness having been precipitated in the alloy.

TABLE 8

| Specimen No. | Composition (% by weight) Cr | Ni | W | Mo | Fe | Co | C | B | Si | Al | Nb | Ti | Hardness HRC | Impact Value (kgf-m/cm$^2$) |
|---|---|---|---|---|---|---|---|---|---|---|---|---|---|---|
| Alloys of Invention | | | | | | | | | | | | | | |
| 62 | Bal. | 30.0 | 10.0 | 2.0 | — | — | — | — | — | — | — | — | 47.5 | 0.85 |
| 63 | Bal. | 40.0 | 5.0 | 3.0 | — | — | — | — | — | — | — | — | 46.0 | 0.95 |
| 64 | Bal. | 45.0 | 2.0 | 6.0 | — | — | — | — | — | — | — | — | 42.3 | 0.85 |
| 65 | Bal. | 45.0 | 2.0 | 1.0 | — | — | — | — | — | — | — | — | 39.0 | 2.81 |
| 66 | Bal. | 30.0 | 12.0 | 1.5 | 0.1 | — | — | — | — | — | — | — | 48.6 | 0.80 |
| 67 | Bal. | 40.0 | 8.0 | 1.5 | 5.0 | — | — | — | — | — | — | — | 42.5 | 0.95 |
| 68 | Bal. | 40.0 | 2.0 | 1.5 | 15.0 | — | — | — | — | — | — | — | 47.0 | 0.65 |
| 69 | Bal. | 45.0 | 2.0 | 1.5 | 2.0 | — | — | — | — | — | — | — | 39.0 | 3.10 |
| 70 | Bal. | 30.0 | 12.0 | 1.5 | — | 0.1 | — | — | — | — | — | — | 48.6 | 0.95 |
| 71 | Bal. | 40.0 | 8.0 | 1.5 | — | 5.0 | — | — | — | — | — | — | 44.2 | 0.85 |
| 72 | Bal. | 45.0 | 2.0 | 1.5 | — | 10.0 | — | — | — | — | — | — | 48.5 | 0.70 |
| 73 | Bal. | 30.0 | 12.0 | 1.5 | 0.1 | 0.1 | — | — | — | — | — | — | 48.1 | 0.90 |
| 74 | Bal. | 40.0 | 8.0 | 1.5 | 5.0 | 5.0 | — | — | — | — | — | — | 46.5 | 0.80 |
| 75 | Bal. | 40.0 | 1.5 | 1.5 | 15.0 | 2.0 | — | — | — | — | — | — | 48.5 | 0.65 |
| 76 | Bal. | 40.0 | 2.0 | 1.5 | 5.0 | 10.0 | — | — | — | — | — | — | 50.0 | 0.65 |
| 77 | Bal. | 45.0 | 2.5 | 1.5 | — | — | 0.5 | — | — | — | — | — | 44.7 | 0.95 |
| 78 | Bal. | 42.5 | 5.0 | 1.5 | — | — | 1.8 | — | — | — | — | — | 45.9 | 0.70 |
| 79 | Bal. | 40.0 | 2.5 | 1.5 | — | — | — | 0.5 | — | — | — | — | 45.3 | 1.10 |
| 80 | Bal. | 40.0 | 2.5 | 1.5 | — | — | — | — | 0.5 | — | — | — | 42.4 | 1.35 |
| 81 | Bal. | 40.0 | 5.0 | 1.5 | — | — | — | — | — | 2.0 | — | — | 43.3 | 1.40 |
| 82 | Bal. | 42.5 | 5.0 | 1.5 | — | — | — | — | 3.0 | 2.0 | — | — | 48.0 | 0.80 |
| 83 | Bal. | 42.5 | 5.0 | 1.5 | — | — | — | — | — | — | 3.8 | — | 42.3 | 0.95 |
| 84 | Bal. | 38.0 | 10.0 | 1.5 | — | — | — | — | — | — | — | 2.0 | 46.7 | 0.90 |
| 85 | Bal. | 42.5 | 2.5 | 1.5 | — | — | 0.7 | 1.0 | — | — | — | — | 44.3 | 1.10 |
| 86 | Bal. | 45.0 | 5.0 | 1.5 | 2.0 | 2.0 | 0.5 | 0.2 | 0.5 | 1.0 | 1.5 | 1.0 | 45.1 | 0.90 |
| 87 | Bal. | 38.0 | 7.0 | 1.5 | 2.0 | 2.0 | — | — | 0.5 | 1.0 | 2.0 | 1.0 | 47.0 | 0.85 |
| Control | | | | | | | | | | | | | | |
| 9 | Bal. | 30.0 | 15.0 | 3.0 | — | — | — | — | — | — | — | — | 59.0 | 0.10 |

(Embodiment 6)

Nineteen kinds of molten alloys are prepared by adding to nineteen alloys selected from the alloys in embodiments 1 to 5 one or more of aluminum, titanium, oxygen, yttrium, misch metal, zirconium and hafnium in such amounts as to make the resulting compositions of the alloys as shown in Table 9. Each of the molten alloys is atomized by an atomizer using nitrogen gas. The atomized alloys are cooled in the atmosphere of nitrogen so that hard facing chromium-base alloy powders superior in toughness are obtained. The amount of oxygen is controlled by adjusting the gas atomizing conditions.

Each of the powders obtained in the above manner is sieved out to provide alloy powder 53 to 177 μm in particle size. As the powder is put on the surface of a 100 mm×50 mm×10 mm metal base of SS 41, a 1.8 kw laser beam is projected at a defocusing rate b/a of 1.4 onto the alloy powder being deposited on the metal base while the base is moved at a speed of 200 mm/min. The defocusing rate is the distance b between the surface of the metal base and the lens for focusing the laser beam deviced by the focal distance a of the lens. The hard facing layer formed is then checked to see whether sputtering has occurred and the shape of the bead is proper.

As is apparent from Table 9, no sputtering is observed in the hard facing layer, and the bead has a good shape. The alloys of the invention have a good weldability in powder form.

TABLE 9

| Specimen No. | Composition (% by weight) Cr | Ni | W | Mo | Fe | Co | C | B | Si | Nb | Al | Y | Misch-metal | Ti | Zr | Hf | [O] | Weldability Spouttering | Bead Shape |
|---|---|---|---|---|---|---|---|---|---|---|---|---|---|---|---|---|---|---|---|
| Alloys of Invention | | | | | | | | | | | | | | | | | | | |
| 1b | Bal. | 30.0 | 15.0 | — | — | — | — | — | — | — | 0.05 | 0.10 | 0.01 | 0.01 | 0.01 | 0.01 | — | None | Good |
| 2b | Bal. | 40.0 | 8.0 | — | — | — | — | — | — | — | — | 0.05 | — | — | — | — | — | None | Good |
| 3b | Bal. | 45.0 | 2.0 | — | — | — | — | — | — | — | 0.05 | — | — | — | — | — | — | None | Good |
| 47b | Bal. | 30.0 | — | 6.5 | — | — | — | — | — | — | — | 0.03 | — | — | 0.03 | — | — | None | Good |
| 48b | Bal. | 40.0 | — | 3.0 | — | — | — | — | — | — | — | — | 0.01 | — | — | — | — | None | Good |
| 49b | Bal. | 45.0 | — | 1.0 | — | — | — | — | — | — | 0.05 | — | — | 0.02 | — | — | — | None | Good |
| 4b | Bal. | 45.0 | 2.5 | — | — | — | 0.5 | — | — | — | — | — | — | — | 0.2 | — | — | None | Good |

TABLE 9-continued

| Specimen No. | Composition (% by weight) | | | | | | | | | | | | | | | | | Weldability | |
|---|---|---|---|---|---|---|---|---|---|---|---|---|---|---|---|---|---|---|---|
| | Cr | Ni | W | Mo | Fe | Co | C | B | Si | Nb | Al | Y | Misch-metal | Ti | Zr | Hf | [O] | Spoutter-ing | Bead Shape |
| 5b | Bal. | 42.5 | 5.0 | — | — | — | 1.8 | — | — | — | — | — | — | — | — | 0.05 | — | None | Good |
| 6b | Bal. | 40.0 | 2.5 | — | — | — | — | 0.5 | — | — | 0.03 | — | 0.03 | 0.03 | — | — | — | None | Good |
| 8b | Bal. | 42.5 | 5.0 | — | — | — | — | — | — | 3.8 | 0.09 | — | — | — | — | — | — | None | Good |
| 13b | Bal. | 30.0 | 15.0 | — | — | — | — | — | 0.1 | 0.1 | — | 0.08 | — | — | — | — | — | None | Good |
| 15b | Bal. | 45.0 | 2.0 | — | — | — | — | — | 3.0 | — | — | | 0.10 | — | — | — | — | None | Good |
| 23b | Bal. | 45.0 | 5.0 | — | — | — | 0.5 | 0.2 | 0.5 | 1.5 | 1.00 | — | — | 0.09 | — | — | — | None | Good |
| 66b | Bal. | 30.0 | 12.0 | 1.5 | 0.1 | — | — | — | — | — | — | — | — | — | 0.08 | — | — | None | Good |
| 68b | Bal. | 40.0 | 2.0 | 1.5 | 15.0 | — | — | — | — | — | — | — | — | — | — | 0.09 | — | None | Good |
| 70b | Bal. | 30.0 | 12.0 | 1.5 | — | 0.1 | — | — | — | — | — | — | — | — | 0.03 | 0.03 | — | None | Good |
| 72b | Bal. | 45.0 | 2.0 | 1.5 | — | 10.0 | — | — | — | — | 0.03 | 0.03 | — | — | — | — | 0.01 | None | Good |
| 80b | Bal. | 40.0 | 2.5 | 1.5 | — | — | — | — | 0.5 | — | 0.03 | — | — | — | 0.03 | — | 0.05 | None | Good |
| 86b | Bal. | 45.0 | 5.0 | 1.5 | 2.0 | 2.0 | 0.5 | 0.2 | 0.5 | 1.5 | 1.00 | — | 0.05 | — | — | 0.03 | 0.10 | None | Good |

Nont: [O] = Oxygen.

(Embodiment 7)

Twenty-six alloys are selected from the alloys prepared in embodiments 1 to 5 to prepare twenty-six kinds of molten alloy having compositions as shown in tables 11 and 12. The molten alloys are atomized by an atomizer using nitrogen gas. The atomized alloys are then cooled in the atmosphere of nitrogen so that hard facing chromium-base alloys superior in toughness are obtained. For purposes of comparison, five alloys are selected from the control alloys prepared in embodiments 1 and 5 to prepare five kinds of molten control alloy as shown in table 12. The molten alloy of each of the five kinds is powdered in the same manner as mentioned just above. The oxygen content in the alloys is controlled by adjusting the gas atomizing conditions.

Each of the powders obtained in the above manner is sieved out to provide alloy powder 44 to 177 μm in particle size. Each of the powders is then welded by plasma arc on the surface of a 100 mm×50 mm×10 mm metal base of SS 41 under the conditions shown in Table 10. The resulting hard facing layer is observed for the shape of the bead formed, and checked by X-rays for blowholes in the hard facing layer.

Hardness and impact tests are also conducted on the specimens made of the above-mentioned molten alloys before atomization. The results are given in Tables 11 and 12.

TABLE 10

| | |
|---|---|
| Metal Base | 100 × 50 × 10 mm |
| Material of Metal Base | SS41 |
| Plasma Gas Flow Rate | 4.0 l/min |
| Welding Current | 110 A |
| Welding Speed | 100 mm/min |
| Amount Supplied | 30 g/min |

TABLE 11

| Specimen No. | Composition (% by weight) | | | | | | | | | | | | | Hardness HRC | Impact Value (kgf-m/cm²) | Bead Shape | | | Blowhole |
|---|---|---|---|---|---|---|---|---|---|---|---|---|---|---|---|---|---|---|---|
| | Cr | Ni | W | Mo | Fe | Co | C | B | Si | Al | Nb | Ti | [O] | | | Bead Width | Unevenness | Roughness | |
| Alloys of Invention | | | | | | | | | | | | | | | | | | | |
| 1a | Bal. | 30.0 | 15.0 | — | — | — | — | — | — | 0.001 | — | — | 0.09 | 48.1 | 0.90 | Uniform | Uniform | None | None |
| 2a | Bal. | 40.0 | 8.0 | — | — | — | — | — | — | 0.05 | — | — | 0.05 | 40.2 | 2.10 | Uniform | Uniform | None | None |
| 3a | Bal. | 45.0 | 2.0 | — | — | — | — | — | — | 0.12 | — | — | 0.01 | 37.5 | 3.40 | Uniform | Uniform | None | None |
| 47a | Bal. | 30.0 | — | 6.5 | — | — | — | — | — | 0.001 | — | — | 0.08 | 49.5 | 0.75 | Uniform | Uniform | None | None |
| 48a | Bal. | 40.0 | — | 3.0 | — | — | — | — | — | 0.05 | — | — | 0.06 | 39.8 | 2.15 | Uniform | Uniform | None | None |
| 49a | Bal. | 45.0 | — | 1.0 | — | — | — | — | — | 0.12 | — | — | 0.03 | 37.0 | 3.05 | Uniform | Uniform | None | None |
| 4a | Bal. | 45.0 | 2.5 | — | — | — | 0.5 | — | — | 0.001 | — | — | 0.10 | 40.3 | 1.20 | Uniform | Uniform | None | None |
| 5a | Bal. | 42.5 | 5.0 | — | — | — | 1.8 | — | — | 0.05 | — | — | 0.06 | 43.6 | 0.95 | Uniform | Uniform | None | None |
| 8a | Bal. | 42.5 | 5.0 | — | — | — | — | — | — | 0.10 | 3.8 | — | 0.02 | 38.5 | 1.20 | Uniform | Uniform | None | None |
| 9a | Bal. | 38.0 | 10.0 | — | — | — | — | — | — | 0.10 | — | 2.0 | 0.08 | 45.0 | 1.00 | Uniform | Uniform | None | None |
| 13a | Bal. | 30.0 | 15.0 | — | — | — | — | — | 0.1 | 0.08 | — | — | 0.05 | 48.5 | 0.90 | Uniform | Uniform | None | None |
| 15a | Bal. | 45.0 | 2.0 | — | — | — | — | — | 3.0 | 0.07 | — | — | 0.01 | 46.5 | 1.10 | Uniform | Uniform | None | None |
| 11a | Bal. | 45.0 | 5.0 | — | — | — | 0.5 | 0.2 | 0.1 | 1.00 | 1.5 | 1.0 | 0.05 | 43.5 | 1.15 | Uniform | Uniform | None | None |
| 12a | Bal. | 38.0 | 7.0 | — | — | — | — | — | — | 1.00 | 2.0 | 1.0 | 0.06 | 44.3 | 1.15 | Uniform | Uniform | None | None |
| 66a | Bal. | 30.0 | 12.0 | 1.5 | 0.1 | — | — | — | — | 0.12 | — | — | 0.08 | 48.6 | 0.80 | Uni- | Uniform | None | None |

TABLE 11-continued

| Specimen No. | Composition (% by weight) Cr | Ni | W | Mo | Fe | Co | C | B | Si | Al | Nb | Ti | [O] | Hardness HRC | Impact Value (kgf-m/cm²) | Bead Shape: Bead Width | Unevenness | Roughness | Blowhole |
|---|---|---|---|---|---|---|---|---|---|---|---|---|---|---|---|---|---|---|---|
| 68a | Bal. | 40.0 | 2.0 | 1.5 | 15.0 | — | — | — | — | 0.08 | — | — | 0.09 | 47.0 | 0.65 | form Uniform | Uniform | None | None |

Note: [O] = Oxygen.

TABLE 12

| Specimen No. | Composition (% by weight) Cr | Ni | W | Mo | Fe | Co | C | B | Si | Al | Nb | Ti | [O] | Hardness HRC | Impact Value kgf-m/cm²) | Bead Shape: Bead Width | Unevenness | Roughness | Blowhole |
|---|---|---|---|---|---|---|---|---|---|---|---|---|---|---|---|---|---|---|---|
| Alloys of Invention | | | | | | | | | | | | | | | | | | | |
| 70a | Bal. | 30.0 | 12.0 | 1.5 | — | 0.1 | — | — | — | 0.06 | — | — | 0.10 | 48.6 | 0.95 | Uniform | Uniform | None | None |
| 72a | Bal. | 45.0 | 2.0 | 1.5 | — | 10.0 | — | — | — | 0.05 | — | — | 0.04 | 48.5 | 0.70 | Uniform | Uniform | None | None |
| 34a | Bal. | 40.0 | 2.0 | — | 15.0 | 2.0 | — | — | — | 0.08 | — | — | 0.09 | 48.2 | 0.66 | Uniform | Uniform | None | None |
| 80a | Bal. | 40.0 | 2.5 | 1.5 | — | — | — | — | 0.5 | 0.07 | — | — | 0.06 | 42.4 | 1.35 | Uniform | Uniform | None | None |
| 77a | Bal. | 45.0 | 2.5 | 1.5 | — | — | 0.5 | — | 3.0 | 0.07 | — | — | 0.08 | 44.7 | 0.95 | Uniform | Uniform | None | None |
| 78a | Bal. | 42.5 | 5.0 | 1.5 | — | — | 1.8 | — | — | 0.10 | — | — | 0.05 | 45.9 | 0.70 | Uniform | Uniform | None | None |
| 83a | Bal. | 42.5 | 5.0 | 1.5 | — | — | — | — | — | 0.09 | 3.8 | — | 0.07 | 42.3 | 0.95 | Uniform | Uniform | None | None |
| 84a | Bal. | 38.0 | 10.0 | 1.5 | — | — | — | — | — | 0.11 | — | 2.0 | 0.10 | 46.7 | 0.90 | Uniform | Uniform | None | None |
| 85a | Bal. | 42.5 | 2.5 | 1.5 | — | — | 0.7 | 1.0 | — | 0.05 | — | — | 0.07 | 44.3 | 1.10 | Uniform | Uniform | None | None |
| 86a | Bal. | 45.0 | 5.0 | 1.5 | 2.0 | 2.0 | 0.5 | 0.2 | 0.5 | 0.05 | 1.5 | 1.0 | 0.09 | 45.1 | 0.90 | Uniform | Uniform | None | None |
| 87a | Bal. | 38.0 | 7.0 | 1.5 | 2.0 | 2.0 | — | — | 0.5 | 0.12 | 2.0 | 1.0 | 0.08 | 47.0 | 0.85 | Uniform | Uniform | None | None |
| Control Alloys | | | | | | | | | | | | | | | | | | | |
| 1a | Bal. | 50.0 | 3.0 | — | — | — | — | — | — | — | — | — | 0.5 | 16.5 | 10.7 | Uniform | Uniform | None | Existing |
| 9a | Bal. | 30.0 | 15.0 | 3.0 | — | — | — | — | — | — | — | — | 0.3 | 59.0 | 0.10 | Uniform | Non-uniform | None | Existing |
| 3a | 20.0 | Bal. | 20.0 | — | — | — | — | — | — | — | — | — | 0.5 | 8.0 | 14.3 | Uniform | Non-uniform | None | Existing |
| 4a | Co—Cr Alloy: Bal.Co—28Cr—4W—1C—eFe—0.5[O] | | | | | | | | | | | | | 43.0 | 1.00 | Uniform | Non-uniform | None | Existing |
| 5a | Ni—Cr Alloy: Bal. Ni—12Cr—2.5B—3.75Si—0.5C—4.5Fe—0.3[O] | | | | | | | | | | | | | 47.0 | 0.15 | Uniform | Uniform | None | Existing |

Note: [O] = Oxygen.

As is apparent from Tables 11 and 12, with the alloy powders of the invention, the bead has a good shape with no blowholes having been formed in the hard facing layer. With the control alloy powders containing oxygen in an amount outside the range of oxygen content of the invention, blowholes are observed. This means that the amount of oxygen contained in the alloys is responsible for formation of blowholes.

(Embodiment 8)

Three of the alloys of the invention and a control Co-Cr alloy as given in Table 13 are melted and atomized by using nitrogen gas and then cooled in the atmosphere of nitrogen to obtain four kinds of alloy powder. Each of the alloy powders is applied onto a JIS SUH 35 base plate to form a hard facing layer by plasma welding under the conditions shown in Table 10.

Each of the specimens formed in the above manner is set in a high-temperature wear testing machine with the testing temperature and load approximating those conditions to which an automobile engine valve is exposed in acutal use. A valve seat made of a sintered iron-base material containing hard particles is used as a counterpart, and the amount lost by wear of the material of each of the specimens tested is measured. The results of measurement are shown in Table 13.

TABLE 13

| Specimen No. | Composition (% by weight) Cr | Ni | W | C | B | Si | Volume Loss by Wear × $10^{-3}$ ($mm^3$) |
|---|---|---|---|---|---|---|---|
| Alloys of Invention | | | | | | | |
| 88 | Bal. | 42.5 | 2.5 | — | — | 1.0 | 2.0 |
| 89 | Bal. | 43.5 | 5.0 | — | 0.5 | — | 5.2 |
| 90 | Bal. | 42.0 | 2.5 | 0.3 | — | 1.0 | 4.8 |
| Control Alloy | | | | | | | |
| 10 | Co—Cr Alloy: Bal.Co—29Cr—8W—1.4C—2.5Fe | | | | | | 11.5 |

Figure 3B:
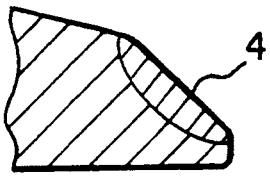
FIGS. 3*a* and 3*b* are side views partially in vertical section, of an automobile engine valve.
Figure 3A:
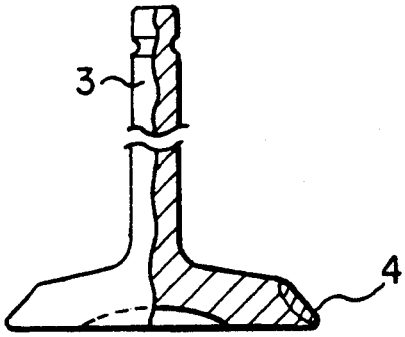

As shown in Table 13, the volume lost by wear of the specimens hard-faced with the alloys of the invention is less than that of the specimen hard-faced with the control alloy No. 10. Therefore, the wear resistance of an automobile engine valve can be improved by hard facing the face portion of the valve with the alloys of the invention as shown in FIG. 3. Improvement in the wear resistance leads to a long life of the valve while enabling the engine to rotate at a higher speed and produce a higher power. The high corrosion resistance of the alloys of the invention helps increase the longevity of the valve in a corroding environment in an automobile engine adapted for leaded gasoline. The alloy powders of the invention have a good weldability by laser or plasma. In short, the alloys of the invention are suitable for forming a hard facing layer by welding.

As mentioned above, the hard facing chromium-base alloys of the invention are superior to the conventional alloys in toughness, and wear and corrosion resistance. Due to their superior properties, the alloys of the invention can be used as a material to be combined with ceramics to form composite materials. The alloys of the invention can have various other applications. For example, a layer can be formed of an alloy of the invention on the interior surface of a cylinder by HIP.

The alloys of the invention can be used not only as a material for hard facing machine parts but also as a material to make sintered machine parts by powder metallurgy. The alloys of the invention can be used to make near-net-shape machine parts by MIM or HIP. The alloys of the invention can be formed directly into a machine part by precision casting.

With the alloy powders of the invention containing one or more of aluminum, yttrium, misch metal, titanium, zirconium and hafnium, no sputtering occurs in the hard facing layer, and the bead has a good shape. By restricting the amount of oxygen contained in the alloy powders of the invention it is possible to prevent blowholes from being formed in the hard facing layer thereby to enable high-speed, high-quality automatic welding using alloy powder.

When the alloys of the invention are used for hard facing automobile engine valves, the superior wear and corrosion resistance thereof makes the valves suitable for use in high-speed, high-power engines for a long time.

What we claim is:

1. A hard facing chromium-base alloy consisting essentially of 30.0 to 48.0% by weight of nickel; 1.5 to 15.0% by weight of tungsten and/or 1.0 to 6.5% by weight of molybdenum; and one or more of 0.3 to 2.0% by weight of carbon, 0.1 to 1.5% by weight of boron, 0.5 to 2.5% by weight of aluminum and 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

2. A hard facing chromium-base alloy consisting essentially of 30.0 to 48.0% by weight of nickel; 1.5 to 15.0% by weight of tungsten and/or 1.0 to 6.5% by weight of molybdenum; and one or more of 15.0 or less % by weight of iron and/or 10.0 or less % by weight of cobalt wherein the maximum sum of iron and cobalt is 20% by weight, 0.3 to 2.0% by weight of carbon, 0.1 to 1.5% by weight of boron, 0.5 to 2.5% by weight of aluminum and 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

3. A hard facing chromium-base alloy consisting essentially of 30.0 to 48.0% by weight of nickel; 1.5 to 15.0% by weight of tungsten and/or 1.0 to 6.5% by weight of molybdenum; and one or more of 1.0 to 4.0% by weight of niobium and/or 0.5 to 2.5% by weight of titanium wherein the maximum sum of niobium and titanium is 5.0% by weight, 0.3 to 2.0% by weight of carbon, 0.1 to 1.5% by weight of boron, 0.5 to 2.5% by weight of aluminum and 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

4. A hard facing chromium-base alloy consisting essentially of 30.0 to 48.0% by weight of nickel; 1.5 to 15.0% by weight of tungsten and/or 1.0 to 6.5% by weight of molybdenum; and one or more of 1.0 to 4.0% by weight of niobium and/or 0.5 to 2.5% by weight of titanium wherein the maximum sum of niobium and titanium is 5.0% by weight, 15.0 or less % by weight of iron and/or 10.0 or less % by weight of cobalt wherein the maximum sum of iron and cobalt is 20% by weight, 0.3 to 2.0% by weight of carbon, 0.1 to 1.5% by weight of boron, 0.5 to 2.5% by weight of aluminum and 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

5. A hard facing chromium-base alloy consisting essentially of 30.0 to 48.0% by weight of nickel; 1.5 to 15.0% by weight of tungsten and/or 1.0 to 6.5% by weight of molybdenum; and one or more of 0.01 to 0.12% by weight of one or more of aluminum, yttrium, misch metal, zirconium and hafnium, 0.3 to 2.0% by weight of carbon, 0.1 to 1.5% by weight of boron, 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

6. A hard facing chromium-base alloy consisting essentially of 30.0 to 48.0% by weight of nickel; 1.5 to 15.0% by weight of tungsten and/or 1.0 to 6.5% by weight of molybdenum; and one or more of 1.0 to 4.0% by weight of niobium and/or 0.5 to 2.5% by weight of titanium wherein the maximum sum of niobium and titanium is 5.0% by weight, 0.01 to 0.12% by weight of one or more or aluminum, yttrium, misch metal, circonium and hafnium, 0.3 to 2.0% by weight of carbon, 0.1 to 1.5% by weight of boron, 0.1 to 1.5% by weight of silicon; the balance being 40.0 or more % by weight of chromium and unavoidable impurities, the maximum sum of tungsten and molybdenum being 15.0 or less % by weight, and comprising a crystallized chromium solid solution as a primary crystalline phase therein.

* * * * *